United States Patent [19]

Walker

[11] 3,933,383

[45] Jan. 20, 1976

[54] LATCH

[76] Inventor: Brooks Walker, 807 Francisco St., San Francisco, Calif. 94109

[22] Filed: Sept. 20, 1974

[21] Appl. No.: 507,761

[52] U.S. Cl. ..... 292/262; 292/263; 292/273; 292/277

[51] Int. Cl.[2] ..... E05C 17/04; E05C 17/06; E05C 17/10; E05C 17/32

[58] Field of Search ..... 292/262, 263, 264, 269, 292/277, 273

[56] References Cited

UNITED STATES PATENTS

| | | | |
|---|---|---|---|
| 916,446 | 3/1909 | Hunt | 292/DIG. 9 |
| 924,081 | 6/1909 | Loev | 292/263 |
| 2,745,692 | 5/1956 | Persson | 292/263 |

*Primary Examiner*—Paul R. Gilliam
*Assistant Examiner*—Carl F. Pietruszka
*Attorney, Agent, or Firm*—Gordon Wood

[57] ABSTRACT

A safety latch for holding a closure such as a door in its locked position or in a partially open position to enhance security. A pair of swingably connected links are provided in combination with a keeper. In one position of the links the closure is held against opening and in another position of the links the closure is held against further opening from a partially opened position.

4 Claims, 10 Drawing Figures

LATCH

This invention relates to a safety latch for holding a closure in a closure structure such as a door or window in either a closed locked position or partially opened position. When holding the closure in closed position the bar provides additional security over that derived from the use of conventional door locks, latches, chains and the like. When holding the closure in a partially opened position it again provides security for the user and permits him to speak through the opening between the closure and the frame without permitting the closure to be swung past the partially opened position or to be picked from the outside as can be done with some "chain" and partially open latches.

The main object of the present invention is to provide a latch of the above described nature which is easily installed on a door or the like and which at the same time provides optimum security for the occupant of the house or apartment using the same.

Heretofore, it has been customary to provide a secondary door holding means in addition to the usual door lock or latch. Such prior art holding means have generally comprised a chain which is secured at one end of the door frame and adapted to be secured at its other end to a slotted member on the door to permit the door to be held in a partially opened position against further opening by a person outside the door. Such chain devices are characteristically weak in construction and the screws holding the chain attaching elements are usually placed in a manner so as not to provide a great amount of resistance against the door being pushed or kicked further open from the outside.

Another object of the invention is the provision of a door holding means which constitutes an improvement over the prior art in that the same is stronger than analogous devices heretofore available.

Other objects and advantages will be apparent from the following specification and from the drawings.

Figure 1:
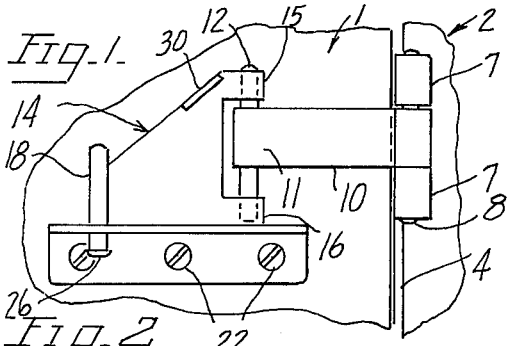
FIG. 1 is a fragmentary elevation of a closure such as a door showing the latch attached to the closure and frame.

Referring to FIG. 1, a portion of a closure such as a door generally designated 1 is shown in its closed position relative to its frame 2. The invention comprises an elongated rectangular plate 4 secured to the frame 2 by means of wood screws 5. Plate 4 is similar to a hinge plate and is provided at its outer edge with bent ears 7 adapted to receive a hinge pin 8 therethrough. Swingably supported on pin 8 is a link 10 which is provided with a bent ear 11 at its opposite end for receiving a pin 12 therethrough.

Figure 3:
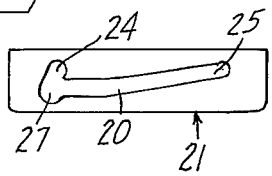
FIG. 3 is a top plan view of the keeper.

Swingably supported on pin 12 is a second link generally designated 14 which is formed at one end with upper and lower ears 15, 16 respectively, in which the pin 12 is secured. Link 14 is provided at its opposite end with a vertically extending pin 18 which may be fixedly secured to link 14 by welding. Pin 18 projects downwardly below the lower edge of link 14 and is adapted to be received within a slot 20 (FIG. 3) formed in one leg of an angle bar keeper 21 which in turn is secured to the closure 1 by means of screws 22 (FIG. 1).

Figure 2:
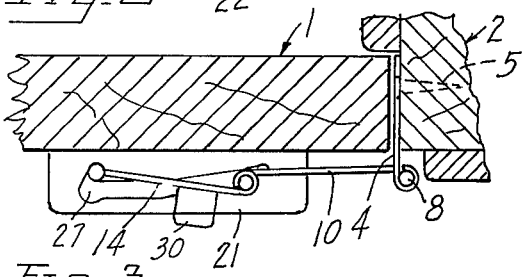
FIG. 2 is a horizontal section through the closure and frame of FIG. 1 showing the latch in plan view.
Figure 4:
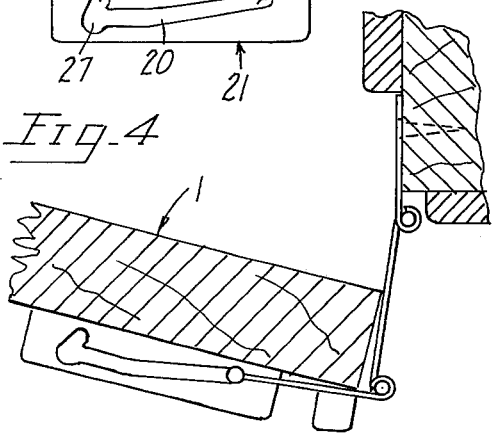
FIG. 4 is a view similar to FIG. 2 showing the closure in secured partially opened position.

Slot 20 is formed at one end with a reentrant portion 24 which, when the pin 18 is received therein, prevents the closure 1 from opening from the position of FIG. 2. The opposite end of slot 20 is formed with an offset portion 25 which, when the pin 18 is moved along the length of slot 20 and into offset portion 25, allows the door to be opened to the partially opened position of FIG. 4. As best seen in FIG. 1, the lower end of pin 18 is upset to provide an enlargement 26 which prevents the pin 18 from being removed from the slot 20 at any point along the length of said slot except at an enlarged portion 27 of said slot at the left hand end thereof. To facilitate manipulation of the link 14, the same may be provided along its upper edge with a horizontally outwardly extending flange 30 by which the link 14 may be moved upwardly relative to the link 10 so that the pin 18 and head 26 may be withdrawn completely out of slot 20 at area 27 if it is desired to swing the links completely away from the door 1 and against the frame 2 to a completely inoperative position.

As noted above, when the links are in a position shown in FIG. 2, the door 1 cannot be opened. If it is desired to place the door in the secured partially opened position of FIG. 4, the pin 18 may be moved out of the portion 24 along the length of the slot 20 and into the end 25 so that the door may be held in the position of FIG. 4 against further opening.

If it is desired not to use the latch the lever 14 may be raised upwardly so that the enlargement 26 on the pin 18 passes through the enlarged portion 27 of the slot 20 thereby permitting the entire assembly to be swung against the frame 2 without any interference to the operation of the door.

Figure 5:
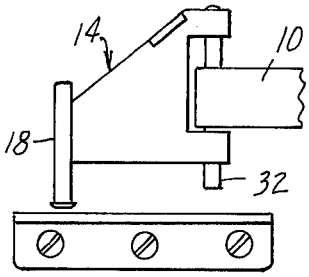
FIG. 5 is a view similar to FIG. 1 showing a modified form of the invention in unlatched position.
Figure 6:
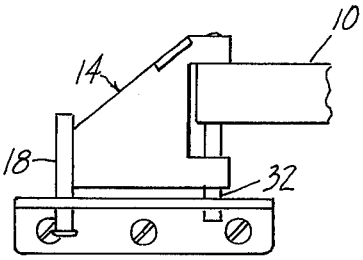
FIG. 6 is a view similar to FIG. 5 with the latch in latched closed door position.
Figure 7:
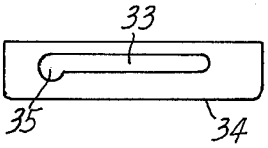
FIG. 7 is a top plan view of the keeper of FIG. 5 and 6.

A modified form of the invention is shown in FIGS. 5–7 wherein the pin connecting the links 10, 14 is provided with an extension 32 adapted to fit within the right hand end of slot 33 in keeper 34 when the latch is in the closed position of FIG. 6. When it is desired to permit the door to be partially opened to the position similar to that shown in FIG. 4, it is merely necessary to raise the lever 14 so that the extension 32 passes out of slot 33 to permit the pin 18 to be moved to the right hand end of slot 33. It will be noted that the enlarged end 35 of slot 33 permits the pin 18 to pass out of slot 33 so that the latch may be moved to the position of FIG. 5 and then swung against the frame if it is desired to make the latch inoperative.

Figure 8:
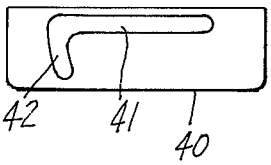
FIG. 8 is a top plan view of a modified form of the keeper.
Figure 9:
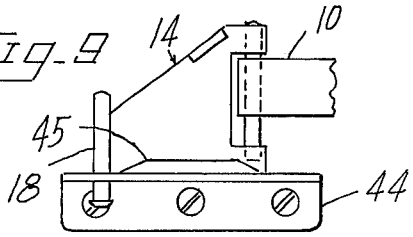
FIGS. 9 and 10 are views of another modified form of keeper also showing the latch.

The latch shown in FIGS. 5,6 may also be employed with a keeper shown in FIG. 8. In this case the keeper 40 is provided with a slot 41 which terminates in an arcuate extension 42 into which the pin 18 may be swung to lock the door in closed position. In order to permit the door to be swung to the partially open position, the pin 18 may be moved to the right hand end of slot 41 and secured against further opening.

The latch structure of FIGS. 1 and 2 may also be employed with a keeper 44 such as that shown in FIGS.

Figure 10:
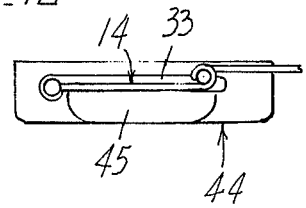

9,10. In this case a slot 33 is provided similar to that shown in FIG. 7 and a cam 45 preferably integral with keeper 44 holds the latch in locked position as seen in FIG. 10. When it is desired to move the latch to the partially opened position, it is merely necessary to raise the link 14 so that the bottom edge of said link is above the cam 45 to permit swinging the pin 18 to the right hand end of slot 33. If the door is to be closed from the partially opened position, it is merely necessary to urge the link 14 to the left so that it automatically rides up on cam 45 and drops into the space between said cam and the door to secure the door in the closed secured position.

It will be seen that the preferred embodiments of the above described invention provide an extremely strong and rugged latch providing adequate protection against unauthorized entrance. It will also be noted that there is no possibility that the door may be opened by an intruder while the latch is being moved from the locked to the partially opened position. Furthermore, when the door is in the closed latched position and also when the door is in the partially open secure position, it cannot be picked from outside because of the presence of head 26 on pin 18.

I claim:

1. A safety latch for holding a closure of a closure structure such as a door, window or the like having a frame, a hinge edge and an opposite latch edge, comprising:

a first link, means swingably connecting one end of said first link to such frame at the latch edge, a second link swingably connected at one of its ends to an opposite end of said first link, and vertically slidable relative to the latter between upper and lower positions, a keeper member carried by said closure and including a horizontally disposed flange formed with an elongated slot, said second link being provided at the end opposite said one end with a projection adapted to be received in said slot, said keeper member being provided with an upwardly projecting portion, whereby said second link may be raised to its upper position and moved to a position between said portion and said closure and lowered to a position interposed between said portion and said closure to hold said closure against opening from a closed position with said projection at one end of said slot, and whereby said latch holds said closure against further opening from a partially open position when said second link is released from said interposed position and said projection is at the opposite end of said slot.

2. A safety latch for holding a closure of a closure structure such as a door, window or the like having a frame, a hinge edge and an opposite latch edge, comprising:

a first link, means swingably connecting one end of said first link to such frame at the latch edge, a second link swingably connected at one of its ends to the opposite end of said first link, a keeper member carried by said closure and formed with an elongated slot, said second link being provided at the end opposite said one end with a projection adapted to be received in said slot, a second projection at the connection between said links and adapted to be also received in said slot when the latch is in locked position, whereby said latch holds said closure against opening when both said projections are in said slot, and whereby said latch holds said closure against further opening from a partially open position when said first projection only is in said slot.

3. A safety latch for holding a door of a door structure that includes a frame, a hinge edge and an opposite latch edge, comprising:

a first link, means swingably connecting one end of said first link to such frame at the latch edge, a second link swingably connected at one of its ends to the opposite end of said first link, a keeper member carried by said door and including a horizontally disposed flange formed with a horizontally elongated slot having a laterally offset portion at one end, said second link being provided at the end opposite said one end with a projection adapted to be received in said slot, whereby said latch holds said door against opening when said projection is in said offset portion of the slot and whereby said latch holds said door against further opening from a partially open position when said projection is at the opposite end of said slot.

4. A safety latch according to claim 3 wherein said portion is an arcuate extension of said slot and in which said projection is received when said latch is in locked position.

* * * * *